US007252105B2

(12) United States Patent
Otis

(10) Patent No.: US 7,252,105 B2
(45) Date of Patent: Aug. 7, 2007

(54) ROLLING CANE, WALKER-TRAINER, SHOPPER WITH AUTOMATIC BRAKING

(76) Inventor: John Francis Otis, P.O. Box 185, Center Hill, FL (US) 33514

( * ) Notice: Subject to any disclaimer, the term of this patent is extended or adjusted under 35 U.S.C. 154(b) by 375 days.

(21) Appl. No.: 10/794,209

(22) Filed: Mar. 5, 2004

(65) Prior Publication Data

US 2004/0216776 A1 Nov. 4, 2004

Related U.S. Application Data

(60) Provisional application No. 60/453,184, filed on Mar. 10, 2003.

(51) Int. Cl.
*A45B 1/02* (2006.01)

(52) U.S. Cl. ..... 135/85; 135/78

(58) Field of Classification Search ..... 135/66, 135/85, 78, 84
See application file for complete search history.

(56) References Cited

U.S. PATENT DOCUMENTS 1,494,508 A * 5/1924 Smith ..... 135/85
2,244,869 A * 6/1941 Everest et al. ..... 135/68
2,683,461 A * 7/1954 Kinney ..... 135/65
4,962,781 A * 10/1990 Kanbar ..... 135/65
5,588,457 A * 12/1996 Tartaglia ..... 135/85
5,692,533 A * 12/1997 Meltzer ..... 135/65
6,158,453 A * 12/2000 Nasco ..... 135/85

FOREIGN PATENT DOCUMENTS

FR 2612476 A1 * 9/1988
JP 9-168414 A * 6/1997
JP 11-196915 A * 7/1999

* cited by examiner

*Primary Examiner*—David R. Dunn

(57) ABSTRACT

A lightweight metal or plastic framework which has a handle (11) at the top of a vertical shaft (12) with built in arms (13,14) below the handle and a bottom shaft (15) attached to the end of the vertical shaft (12). The said bottom shaft (15) is bent down at both ends on which are attached rubber bumper-pivots (16,17) that act as bumpers for the ends of shaft (15) and lift said wheels from said surface when said framework is leaned toward the user. Two bearing fitted wheels (18,19) are attached on the same side of said framework to said bottom shaft (15) by axles (20,21).

1 Claim, 6 Drawing Sheets

ROLLING CANE, WALKER-TRAINER, SHOPPER WITH AUTOMATIC BRAKING

CROSS-REFERENCE

Figure 1:
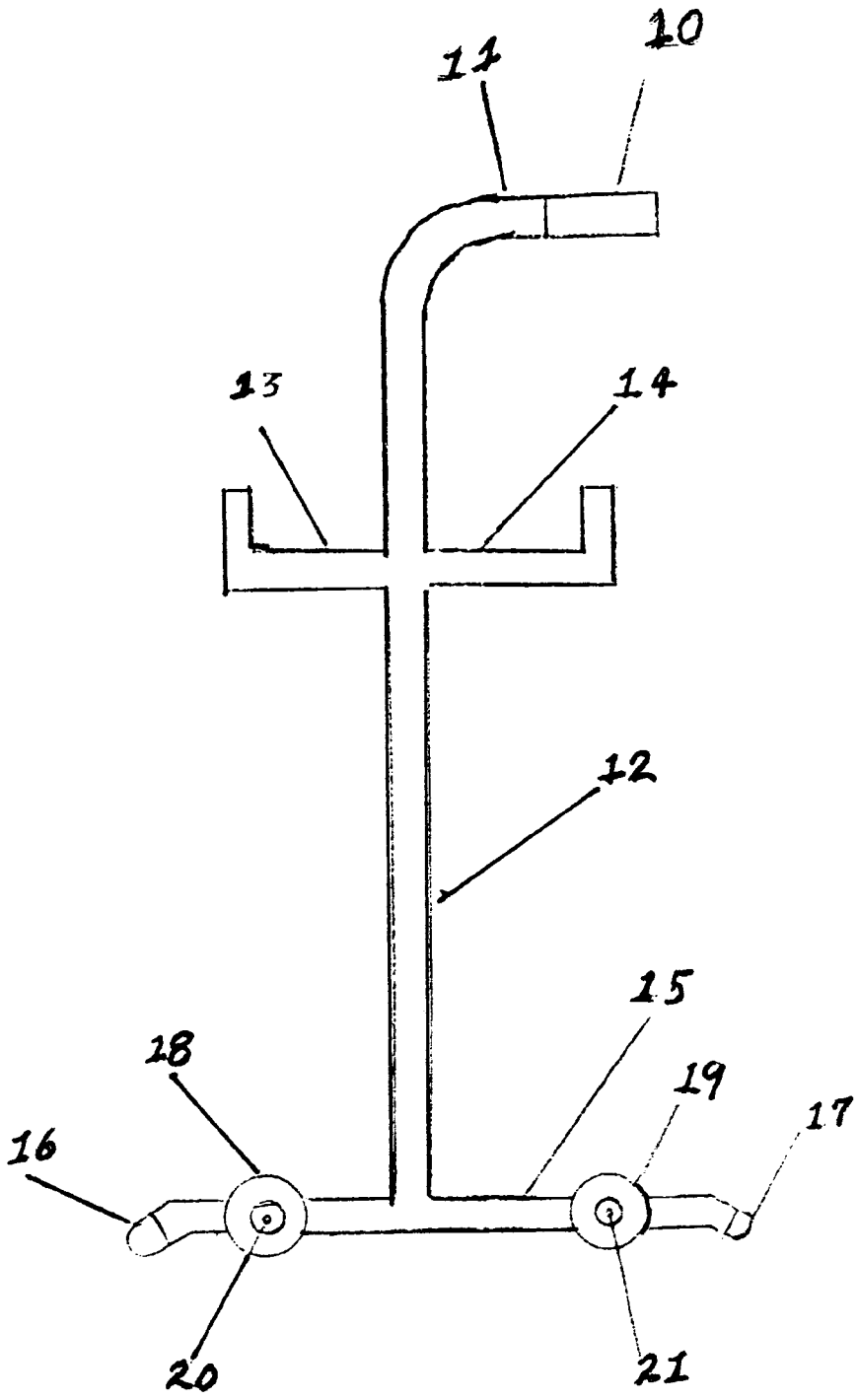

This application claims the benefit of PPA Ser. No. 60/453,184, filed Mar. 10, 2003 by the present inventor.

FEDERALLY SPONSORED RESEARCH

Not applicable

SEQUENCE LISTING OR PROGRAM

Not applicable

BACKGROUND OF THE INVENTION

1. Field of Invention

This invention relates to walking aids, specifically those that are strong, lightweight, easily maneuverable and stable. The Walker-Trainer Shopper with Automatic Braking shall be referred to as WTS in this application. Optional adaptations allow folding of the handle for easy transportation.

2. Discussion of Prior Art

As the cane forms a basic structure this is the point to which the inventor has turned. The following U.S. patents are presentations to fill a need.

U.S. Pat. No. 6,158,453 to Nasco the four wheel cane with brake is equipped soft rubber wheels. This would appear difficult to maneuver in tight spots and require lifting the front wheels in order to brake.

U.S. Pat. No. 5,692,533 to Meltzer a cane with two front wheels and two rear legs with friction stoppers. It must be lifted in order to move or turn.

U.S. Pat. No. 5,588,457 to Tartaglia a attempt to give stability, maneuverability to user.

U.S. Pat. No. 4,962,781 to Kanbar the presentation would be portable but strength and stability would be a question.

U.S. Pat. No. 2,683,461 to Kinney used by the blind with the braking action effective when the ground engaging wheel drops over a curb or in a depression.

U.S. Pat. No. 1,494,508 to Smith a roller cane with a shank that pivots on uneven ground. Designed to aid the blind to walk in a straight line on sidewalks with seams.

OBJECTS AND ADVANTAGES

Accordingly, several objects and advantages of my WTS are found in the strong lightweight metal or plastic framework that is not bulky but easy to move on bearing fitted wheels the length of the bottom shaft gives a sense of stability when using the WTS the user can stop the WTS movement by leaning the WTS towards themselves, to rest the user can lean/sit on the handle, the design shown in PPA application 60/453,184 operates better on rough surfaces then the preferred model with braking capabilities, which is designed for smooth surfaces further objects and advantages of my invention will become apparent since each WTS is made to fit the individual user, there is an information sheet of personal specifications which each user, doctor. therapist or trainer must fill out and submit in order to complete a custom fit, the construction of the WTS will help determine the stability of the user which is the relationship between an aid and the user.

Following is a sample personal specification sheet:

1) List all limbs that are available to use.
2) Do you have any prosthetics?
3) Which hand will you use to control the walking aid?
4) Are you right or left handed?
5) Which side of the body should the walker be used on?
6) What is your weight?
7) What is your height?
8) With your arms dropped to your side what is the measurement from the floor to your wrists when you are standing? (you may need help getting these measurements.)

The above questions are a partial list of some of the information that may be required to construct the WTS.

SUMMARY

In accordance with the present invention a WTS comprises a strong framework with or without braking capabilities, custom fitted to offer the user an optimum amount of security and safety, although not required the user is recommended to have a professional fitting.

DRAWINGS—FIGURES

Figure 2:
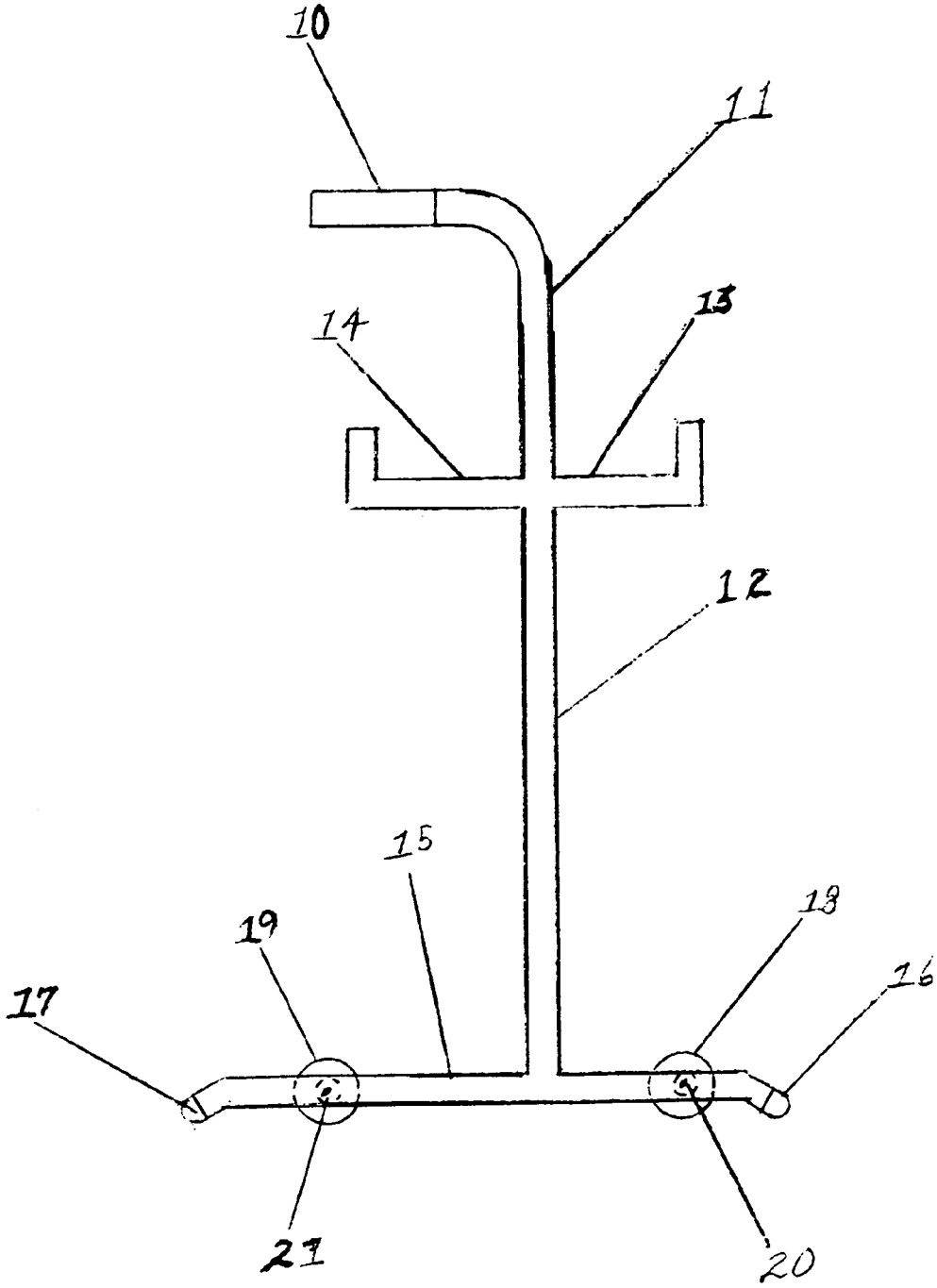
Figure 3:
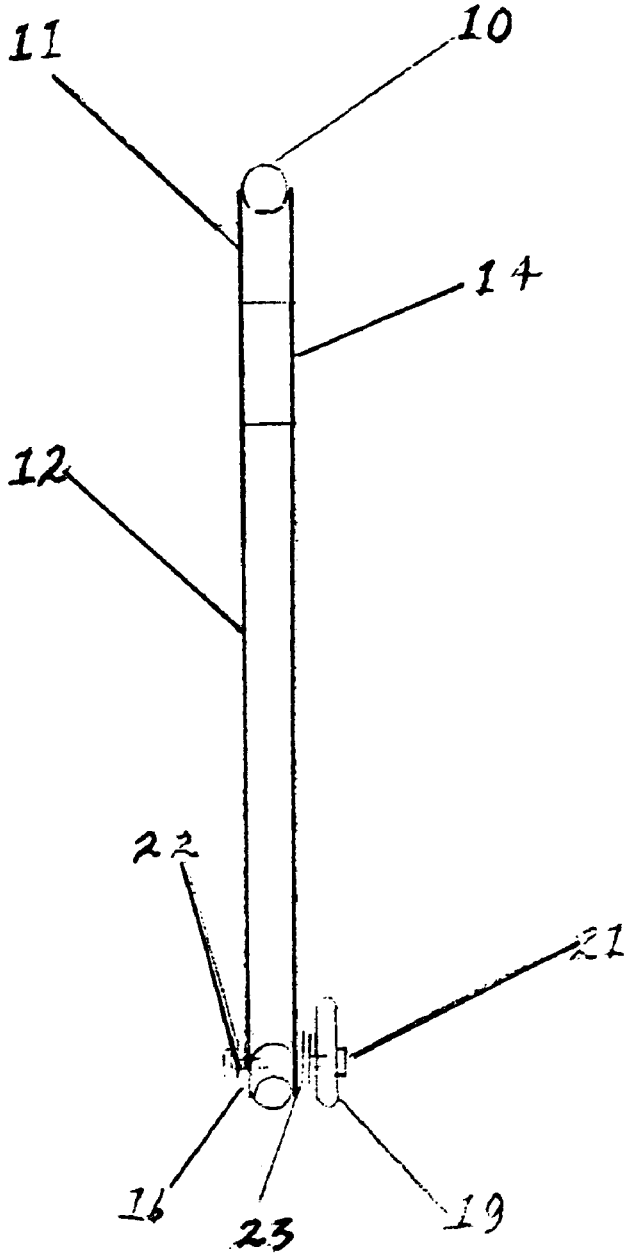
Figure 4:
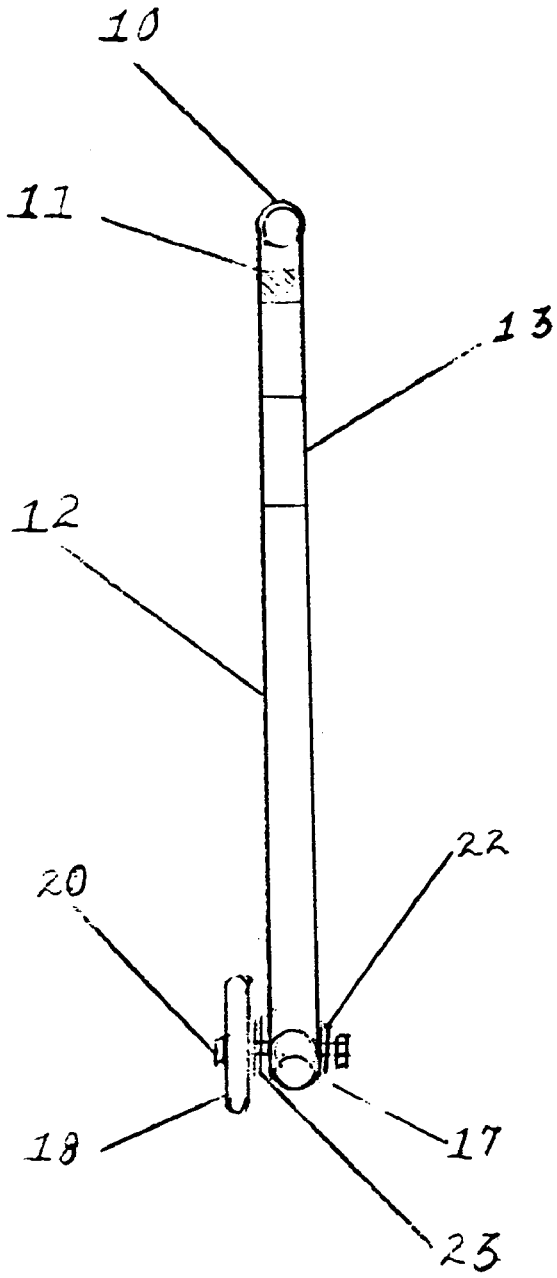
Figure 5:
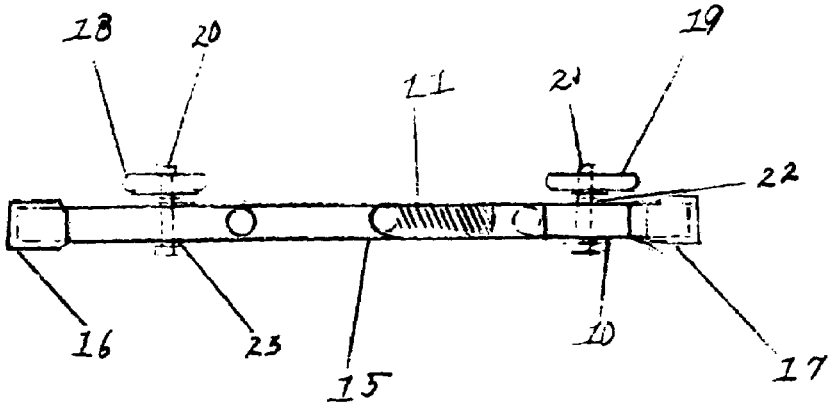
Figure 5:
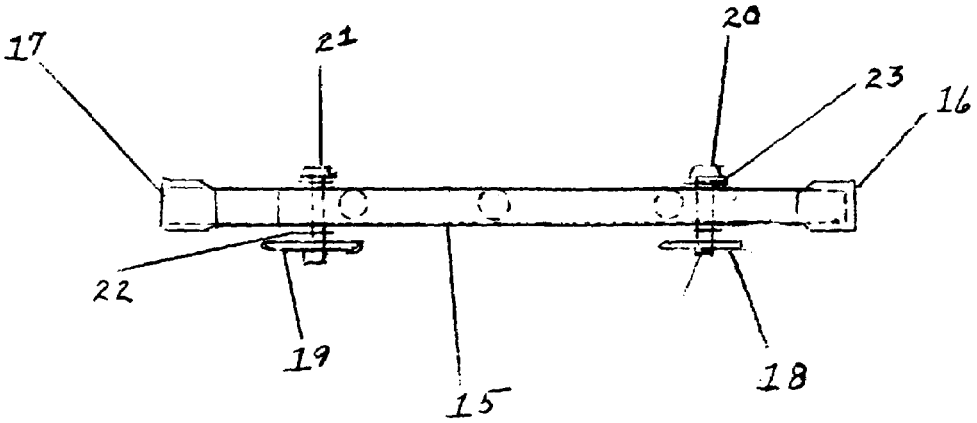
Figure 6:
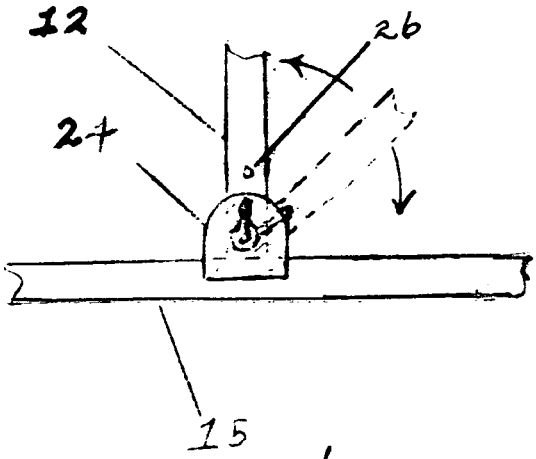
Figure 6:
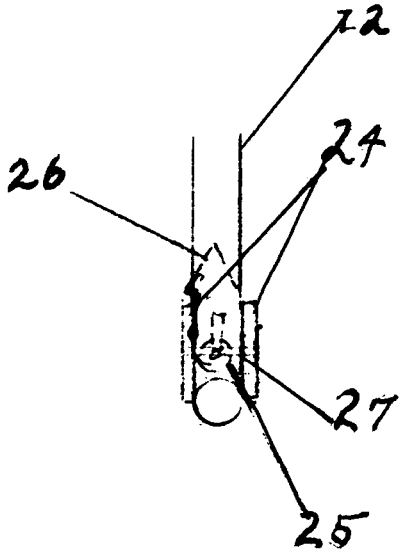

FIG. 1 shows a left side view of WTS
FIG. 2 shows a right side view of WTS
FIG. 3 shows a front view of WTS
FIG. 4 shows a rear view of WTS
FIG. 5 A shows a top view of WTS
FIG. 5 B shows a bottom view of WTS
FIG. 6 A shows a side view of the optional fold down mechanism
FIG. 6 B shows a end view of the optional fold down mechanism Drawings—Reference Numerals

DETAILED DESCRIPTION—FIGS. 1-4 PREFERRED EMBODIMENT

The preferred embodiment of the WTS is found illustrated in the drawings

FIGS. 1-4, 5A and 5B

FIG. 1 shows the handle cover 10 which slides on the handle 11. The handle is bent from the upper end of the vertical shaft 12 which is connected to the bottom shaft 15. The ends of the bottom shaft 15 are bent at an angle and two bumper-pivots 16 and 17 act as protection for the shaft ends and lift the wheels 18 and 19 of the WTS from the surface while arms 13 and 14 carry loose objects. The wheels 18 and 19 are attached to the bottom shaft 15 by axles 20 and 21. As shown in Fig. The wheels 18 and 19 and the opposing axle end are separated from the bottom shaft 15 by washer/spacer 23 and washer 22.

Optional embodiments are shown in FIGS. 6A and 6B. The left side view of FIG. 6A shows one side plate 24 with a cutaway view 25 showing the working mechanism of a ball and stem that rotates on an axle 27 shown in view 6B. The axle 27 is connected between the plates 24 which are attached to the bottom shaft 15. In FIG. 6 view 6A and 6B a button 26 is shown coming through shaft 12 and locking device for shaft 12. An elastic rope or collar can hold shaft 12 and shaft 15 when button 26 is released.

Operation—FIGS. 1, 2

The manner of using the WTS is simpler than leading a baby. With its light weight it is easily guided by a twist of the wrist aiming the WTS in the direction desired. By leaning the WTS toward the user the bumper-pivots 16 and 17 engage said surface lifting said wheels. When the WTS is so inclined and locked by the bumper-pivots it becomes a resting support where one is able to sit or lean on/or against the handle. The design, strength of material and light weight allow for freedom of movement.

I claim:

1. A stable walker-trainer shopper for use on a surface, said stable walker-trainer shopper comprising:

a tube frame including a gripped handle, a bottom shaft, and a vertical shaft extending downward from said gripped handle to a topward side of said bottom shaft, said bottom shaft having two ends, each end configured in a downward bend and having a rubber bumper-pivot mounted thereon, the bottom shaft further including a first side and an opposing second side extending downwardly of said topward side between said ends, more than one wheel attached only to said first side of said bottom shaft via axles that extend parallel to each other and through said bottom shaft, wherein said rubber bumper-pivots and said wheels are mounted on said bottom shaft such that said wheels are removed from the surface by engagement of said rubber bumper-pivots with the surface when said tube frame is leaned toward said second opposing side of said bottom shaft and away from said first side of said bottom shaft.

* * * * *